US008522500B1

(12) United States Patent
Brown

(10) Patent No.: US 8,522,500 B1
(45) Date of Patent: Sep. 3, 2013

(54) STRUCTURAL INSULATED PANEL SYSTEM

(71) Applicant: Hill Phoenix, Inc., Conyers, GA (US)

(72) Inventor: Marion L. Brown, Hurst, TX (US)

(73) Assignee: Hill Phoenix, Inc., Conyers, GA (US)

( * ) Notice: Subject to any disclaimer, the term of this patent is extended or adjusted under 35 U.S.C. 154(b) by 0 days.

(21) Appl. No.: 13/652,076

(22) Filed: Oct. 15, 2012

Related U.S. Application Data

(63) Continuation of application No. 12/690,683, filed on Jan. 20, 2010, now Pat. No. 8,286,399.

(51) Int. Cl.
*E04B 1/74* (2006.01)
*E04C 3/00* (2006.01)

(52) U.S. Cl.
USPC ..... 52/404.4; 52/578; 52/580; 52/581

(58) Field of Classification Search
USPC ..... 52/404, 794.1, 588.1, 404.1, 405.2, 52/406.1, 406.2, 406.3, 404.2, 404.4, 578, 52/580, 581, 782.1, 783.1, 796.1, 796.12
See application file for complete search history.

(56) References Cited

U.S. PATENT DOCUMENTS

| | | | | |
|---|---|---|---|---|
| 358,719 | A | 3/1887 | Baush | 251/203 |
| 2,647,287 | A | 8/1953 | Jones | 52/582.2 |
| 3,280,522 | A | 10/1966 | Palfey et al. | 52/127.9 |
| 3,353,314 | A | 11/1967 | Melcher | 52/127.9 |
| 3,363,383 | A | 1/1968 | Barge | 52/471 |
| 3,421,276 | A | 1/1969 | Barge | 52/287.1 |
| 3,587,199 | A | 6/1971 | Henry | 52/582.2 |
| 3,998,023 | A | 12/1976 | Anderson | 52/592.1 |
| 3,998,024 | A | 12/1976 | Frandsen | 52/592.1 |
| 4,223,500 | A | 9/1980 | Clark et al. | 52/309.4 |
| 4,523,416 | A | 6/1985 | Payne et al. | 52/220.4 |
| 4,774,794 | A | 10/1988 | Grieb | 52/309.7 |
| 4,844,975 | A | 7/1989 | Litzenberger | 428/306.6 |
| 4,974,383 | A | 12/1990 | Derr et al. | 52/582 |
| 4,976,081 | A | 12/1990 | Litzenberger | 52/309.11 |
| 5,343,665 | A | 9/1994 | Palmersten | 52/588.1 |
| 5,424,118 | A * | 6/1995 | McLaughlin | 428/314.8 |
| 5,448,865 | A | 9/1995 | Palmersten | 52/309.9 |
| 5,483,778 | A | 1/1996 | Scrivener | 52/579 |
| 5,497,589 | A | 3/1996 | Porter | 52/309.7 |
| 5,502,939 | A | 4/1996 | Zadok et al. | 52/309.9 |
| 5,519,971 | A | 5/1996 | Ramirez | 52/220.2 |
| 5,628,158 | A | 5/1997 | Porter | 52/309.9 |
| 6,119,427 | A | 9/2000 | Wyman et al. | 52/584.1 |

(Continued)

*Primary Examiner* — Mark Wendell
(74) *Attorney, Agent, or Firm* — Nixon Peabody LLP

(57) ABSTRACT

An insulated enclosure includes a plurality of walls, each of the walls comprising structural insulated panels joined to adjoining structural insulated panels by joints. Each of the structural insulated panels includes a frame having a first vertical frame member, a second vertical frame member, a top frame member, a bottom frame member, and siding members disposed on opposing sides of the frame to define a cavity therebetween. The vertical frame members define, on an outwardly disposed surface thereof, a plurality of vertical recesses and projections. The joints between the plurality of structural insulated panels are butyl-free and include butyl-free compressible seals disposed between opposing recesses and projections in adjoining structural insulated panels. Insulation is disposed within the structural insulated panels and within at least a portion of at least one structural insulated panel vertical frame member.

6 Claims, 8 Drawing Sheets

(56) References Cited

U.S. PATENT DOCUMENTS

| | | | | |
|---|---|---|---|---|
| 7,188,456 | B2 | 3/2007 | Knauseder | 52/592.1 |
| 7,752,822 | B2 | 7/2010 | Minelli | 52/589.1 |
| 2006/0185306 | A1 | 8/2006 | Fletcher | 52/591.1 |
| 2006/0260268 | A1 | 11/2006 | Ritchie | 52/783.1 |
| 2008/0086965 | A1* | 4/2008 | Metz et al. | 52/309.9 |
| 2009/0025334 | A1 | 1/2009 | Aquilina et al. | 52/784.13 |
| 2009/0100780 | A1 | 4/2009 | Mathis et al. | 52/578 |
| 2011/0072746 | A1 | 3/2011 | Dagher et al. | 52/302.1 |

* cited by examiner

STRUCTURAL INSULATED PANEL SYSTEM

FIELD OF THE INVENTION

The present invention relates to a structural insulated panel. The present invention relates more particularly to a structural insulated panel system having improved frame members. The present invention more particularly relates to frame members having joint sealing capabilities intended to eliminate or minimize the need for field-applied sealants. The present invention more particularly relates to frame members having improved thermal insulation performance and reduced weight.

BACKGROUND OF THE INVENTION

It is generally known to provide insulated panels or walls for temperature controlled storage areas (e.g. walk-in coolers, etc.) or for other structures or enclosures where a thermal boundary is desired. Such known walls or panels typically include wall or paneling structures where a layer of an insulation material is installed (e.g. blankets, sheets, etc.) within a cavity of a wall during construction of the wall or structure, or is applied (e.g. spraying a foam material, etc.) to a surface of the wall or structure after construction is complete. Such insulation panels typically have frame members that require field application of a sealant at the joints of the frame members during assembly of the temperature controlled storage areas to prevent condensation from infiltrating the frame members and to reduce heat loss through the joint. Such field application of a sealant is time-consuming, sloppy and often results in varying degrees of effectiveness based upon the skill and expertise of the installer. Also, frame members are typically made from a wood material (e.g. 'two by four' lumber, etc.) due to its relatively low cost and relatively good thermal insulation properties (when compared to metallic frame members). However, such two by four wood frame members usually do not provide the same thermal insulation performance as the body of the insulation panels. Accordingly, it would be desirable to provide a structural insulated panel system having frame members that include an improved joint sealing system, and/or provide improved thermal insulation performance with the benefit of having a reduced weight.

SUMMARY OF THE INVENTION

According to one embodiment, a structural insulated panel system includes a frame having a first vertical frame member and a second vertical frame member and a top frame member and a bottom frame member. A first siding member is attached to at least a portion of one side of the frame and a second siding member is attached to at least a portion of an opposite side of the frame, the frame and the first and second siding members forming a cavity. An insulation material is disposed within the cavity. The first vertical frame member has a plurality of recesses having a first depth and the second vertical frame member has a plurality of projections having a second depth. A first compressible seal is disposed within the recesses and configured to be compressed by the projections of an adjacent panel upon assembly of two panels to one another. A second compressible seal is disposed adjacent to each outside edge of the first or second vertical frame member and configured to be compressed by the other of the first or second vertical frame member upon assembly of two panels to one another. A plurality of voids are formed in at least one of the frame members and filled with the insulation fill material.

According to another embodiment, a structural insulated panel includes a frame having a first vertical frame member and a second vertical frame member and a top frame member and a bottom frame member. A first siding member is attached to at least a portion of one side of the frame and a second siding member is attached to at least a portion of an opposite side of the frame, the frame and the first and second siding members forming a cavity. An insulation material is disposed within the cavity. The first vertical frame member has two or more recesses and the second vertical frame member has two or more projections. A compressible hollow core seal is disposed within the recesses and is configured to be compressed by the projections of an adjacent panel upon assembly of two panels to one another. A compressible solid core seal is disposed adjacent to at least one outside edge of the first or second vertical frame member and is configured to be compressed by the other of the first or second vertical frame member upon assembly of two panels to one another. A plurality of voids are formed in at least one of the frame members and are open to the cavity and filled with the insulation fill material. The plurality of voids include a first elongated void and a plurality of second voids arranged in an alternating pattern.

DETAILED DESCRIPTION OF THE INVENTION

Referring to FIGS. 2A-4D, a structural insulated panel system 100 for use in assembling an enclosure (e.g. walk-in cooler, refrigerated storage area, etc.) or other type of structure (e.g. residential, commercial, industrial, institutional, etc.) having a thermal boundary is shown according to various embodiments. The panels are prefabricated with a frame and siding arrangement that permits rapid and secure assembly of the panels to one another (e.g. in a "plug-and-play" type manner, etc.). The panels may be provided in a wide variety of sizes (e.g. height and width) that may be provided as "standard" sizes (such as within a range of six inches to 48 inches wide, and 8 to 10 feet high) or may also be provided in a wide range of custom order sizes (such as up to 12 feet wide and up to 16 feet high) intended to suit a particular application. The panels may also be provided in various thicknesses as "standard" thicknesses corresponding to a range of desired thermal performance characteristics, or may be provided in custom thicknesses intended to suit a particular application. The thickness of the panels may be varied by changing the thickness of either or both of the siding and the frame. Although the system is shown and described by way of example as having rectangular shaped panels, the system may be used with any of a wide variety of shapes and corner assembly configurations. Further, the panels may be modified for use in particular areas of the enclosure, such as for use as roof panels, etc. Accordingly, all such modifications are intended to be within the scope of the invention as disclosed in reference to the embodiments illustrated and described herein.

Figure 1A:
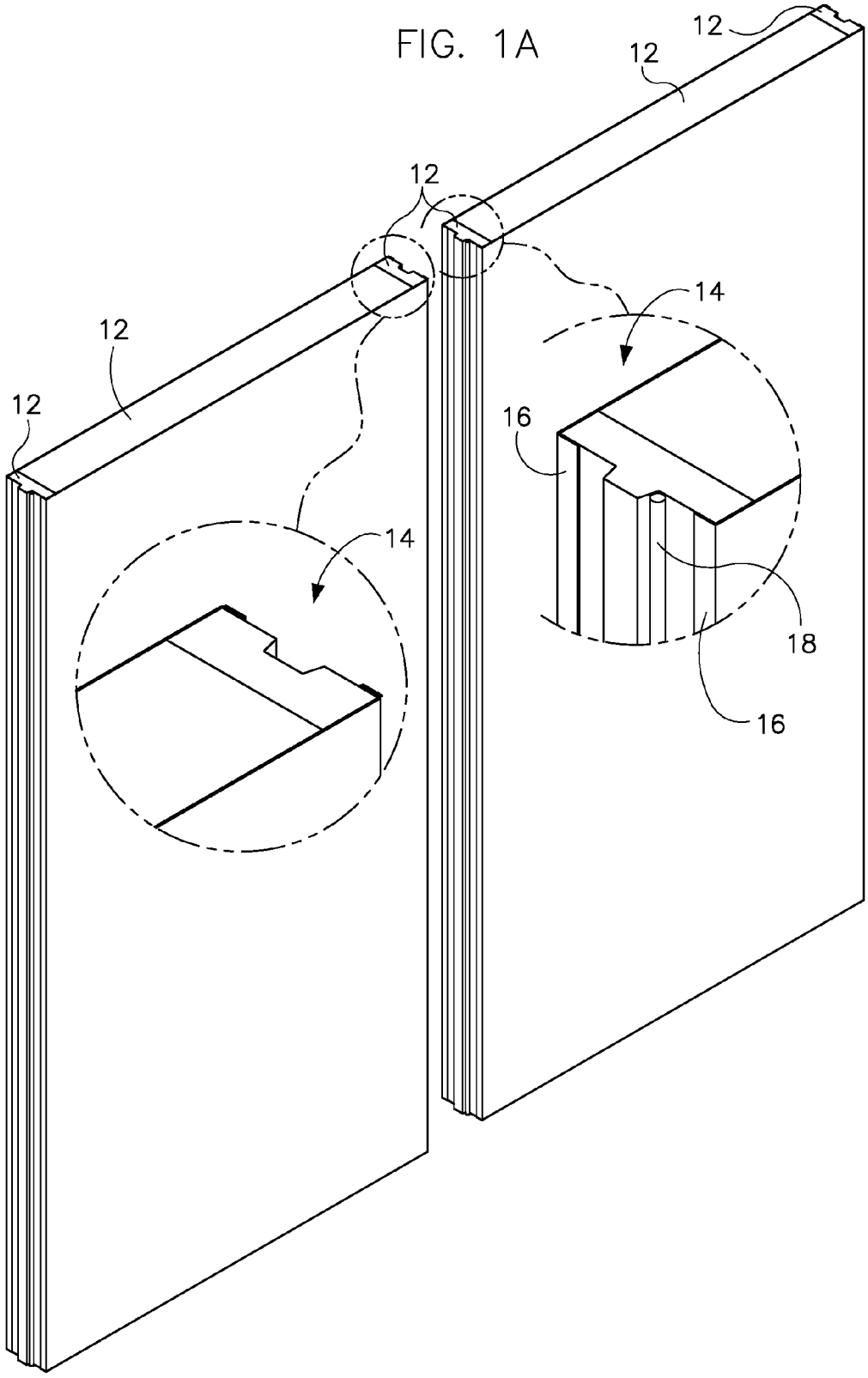
FIG. 1A is a schematic image of a perspective view of a conventional structural insulated panel with frame members and a sealing system.
Figure 1B:
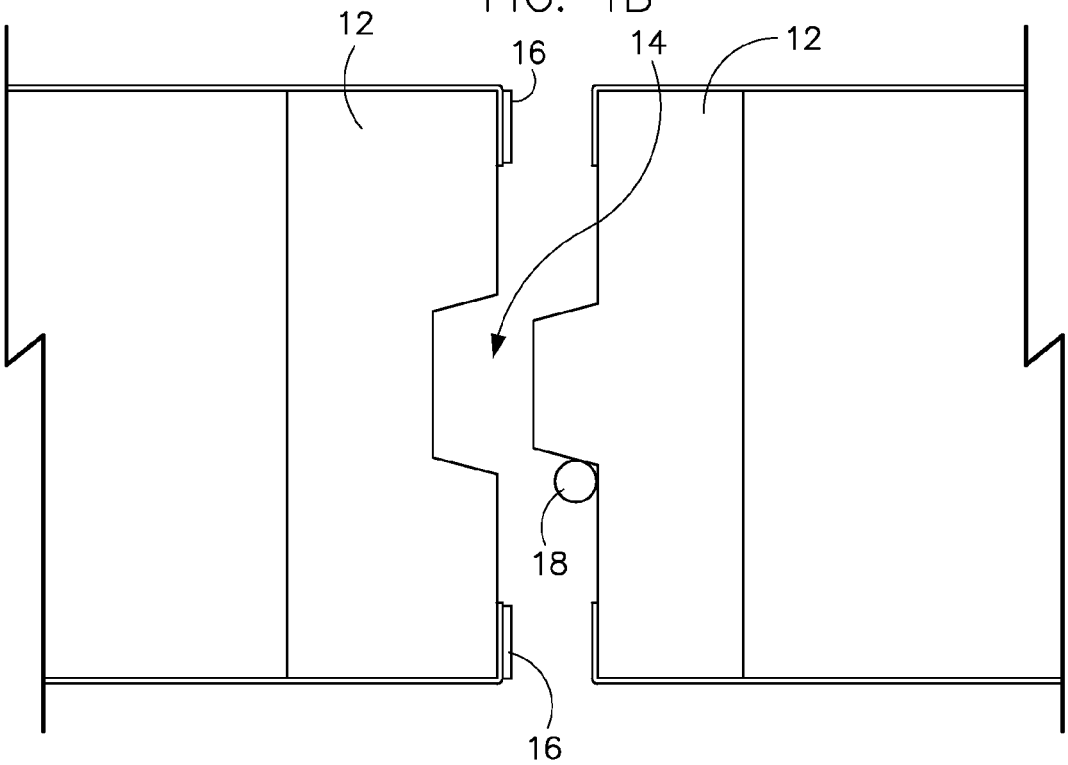
FIG. 1B is a schematic image of a top view of the conventional structural insulated panel with frame members and a sealing system of FIG. 1A with the panels in an "open" (e.g. uncoupled, unjoined, unassembled, etc.) configuration.
Figure 1C:
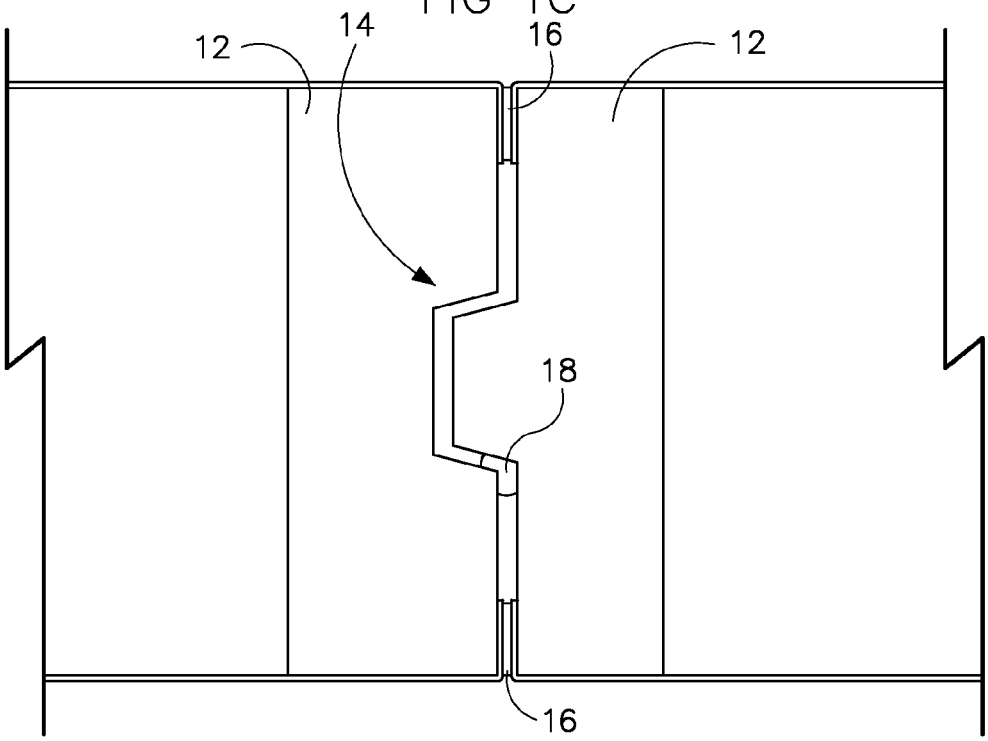
FIG. 1C is a schematic image of a top view of the conventional structural insulated panel with frame members and a sealing system of FIG. 1A with the panels in a "closed" (e.g. coupled, joined, assembled, etc.) configuration.

Referring to FIGS. 1A-1C, a conventional structural insulated panel system with frame members and a field-applied sealant is shown. The conventional panels 10 are shown to include structural frame members 12 generally positioned about a perimeter of the panel. The frame members are typically solid wooden lumber such as two by fours or the like, and may include a tongue and groove arrangement 14. The sealing system may include a flat gasket strip 16 along the outer edges of the face of one of the frame members that is intended to seal against an opposite and adjacent frame member of another panel when the panels are joined together. Such gasket strips, alone, are generally considered to be insufficient to provide a desired level of thermal insulation and moisture barrier protection. Accordingly, such conventional panels also typically include a bead of field-applied sealant 18 such as butyl rubber caulk applied on the face of one of the frame members and along its length that is intended to seal against an opposite and adjacent frame member of another panel when the panels are joined together. Such field application of a sealant is time-consuming, sloppy and often results in varying degrees of effectiveness based upon the skill and expertise of the installer. Also, frame members are typically made from a wood lumber usually do not provide the desired thermal insulation performance. Accordingly, it would be desirable to provide a structural insulated panel system having frame members that include an improved joint sealing system, and/or provide improved thermal insulation performance with the benefit of having a reduced weight.

Figure 2A:
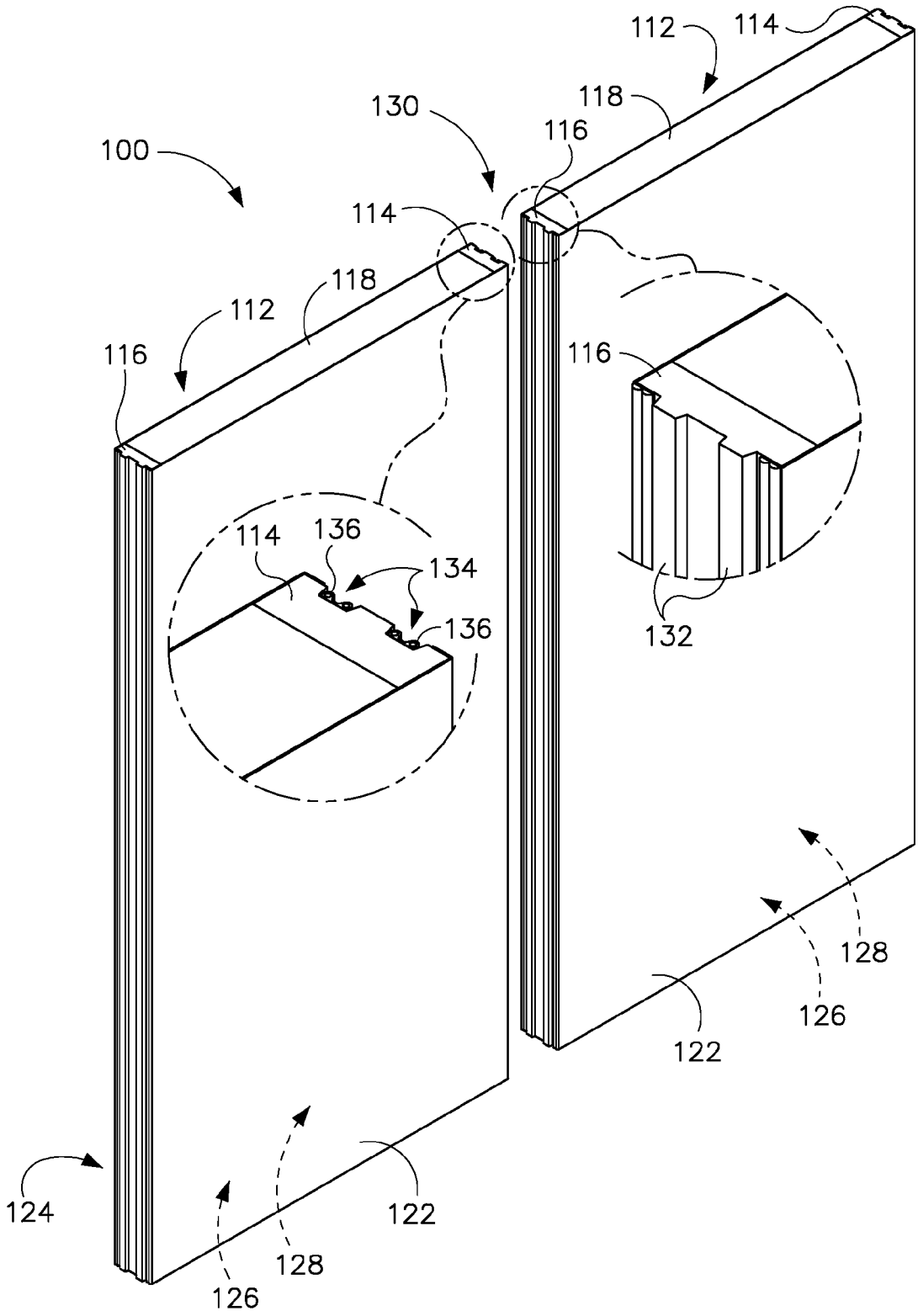
FIG. 2A is a schematic image of a perspective view of a structural insulated panel with frame members and a sealing system, according to an exemplary embodiment.
Figure 2B:
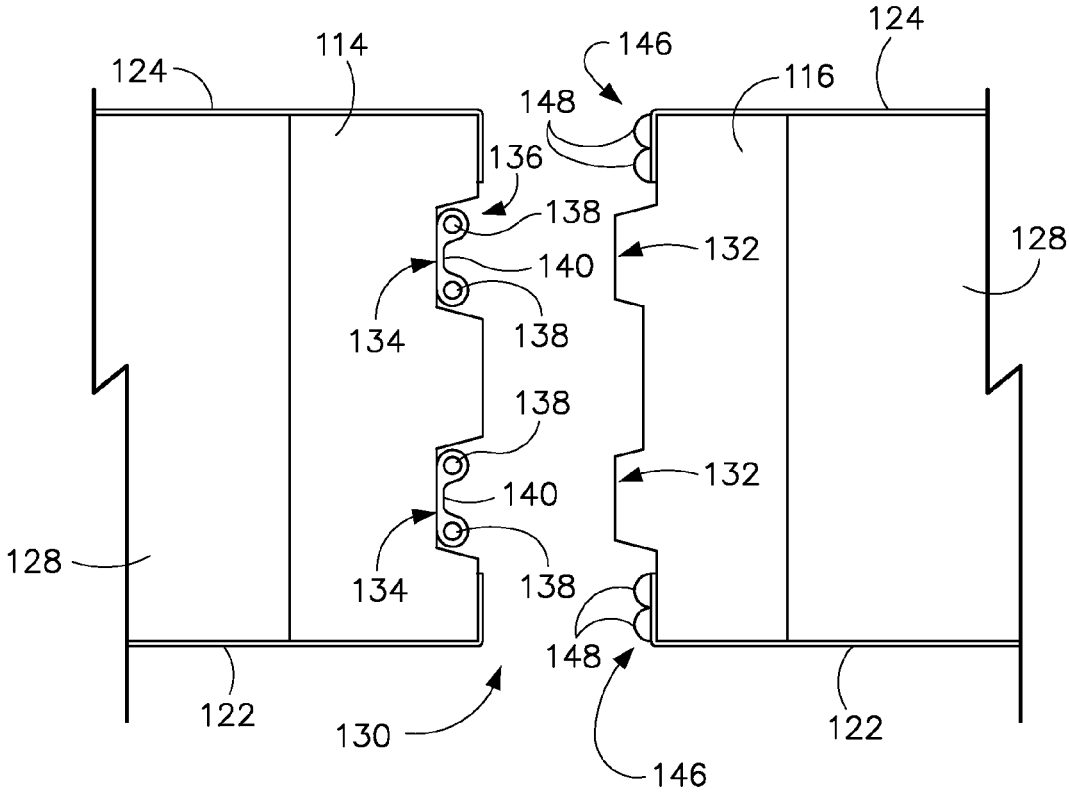
FIG. 2B is a schematic image of a top view of the structural insulated panel with frame members and a sealing system of FIG. 2A with the panels in an "open" (e.g. uncoupled, unjoined, unassembled, etc.) configuration, according to an exemplary embodiment.
Figure 2C:
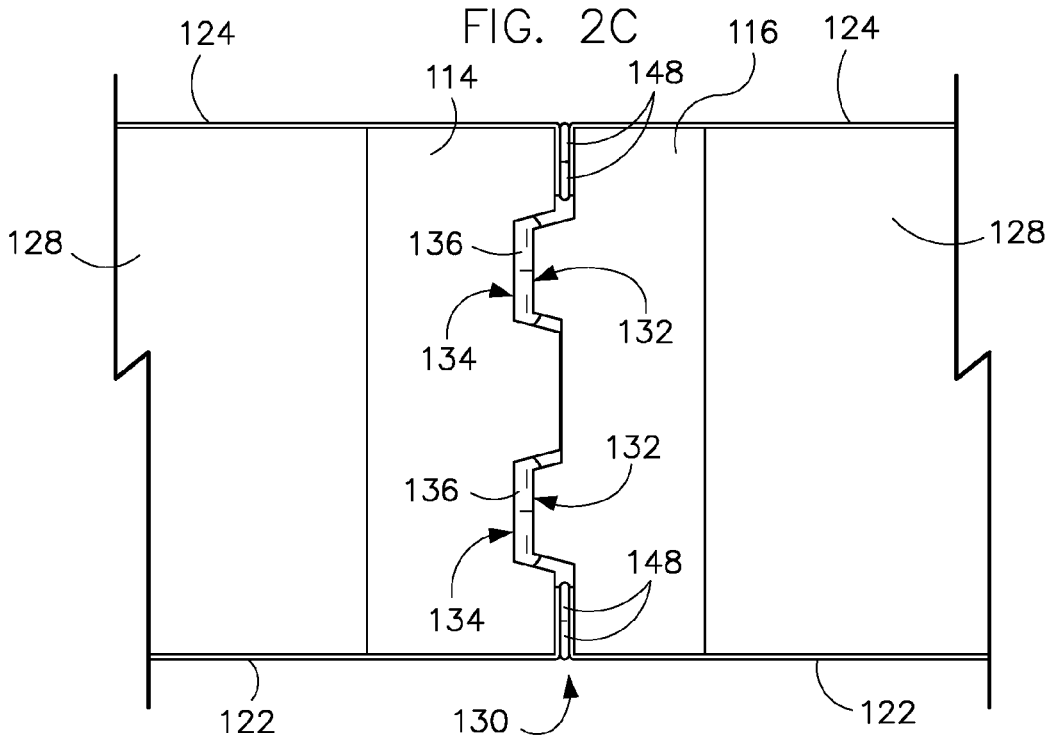
FIG. 2C is a schematic image of a top view of the structural insulated panel with frame members and a sealing system of FIG. 2A with the panels in a "closed" (e.g. coupled, joined, assembled, etc.) configuration, according to an exemplary embodiment.

Referring to FIGS. 2A-2C, a first type of prefabricated structural insulated panels 110 with frame members and sealing system are shown according to an exemplary embodiment. Panels 110 are shown to include a frame 112 having first and second vertical frame members 114, 116 and a top frame member 118 and a bottom frame member 120, a first siding member 122, a second siding member 124, and an insulation fill material therebetween. According to one embodiment, the frame 112 is formed from structural members, such as "two by four" wood lumber to create a wood perimeter frame, although other size lumber (e.g. 2×2, 2×6, 2×8, etc.) may be used to provide panels having a greater or lesser width (e.g. thickness) to suit a desired thermal, fire and/or environmental boundary performance. The frame 112 is also shown formed in the shape of a rectangle having two vertical and two horizontal structural members, each located generally along a perimeter of the panel. However, additional (i.e. internal) structural members may be included (e.g. within the perimeter and extending side-to-side and/or top-to-bottom and/or corner-to-corner) to provide additional structural support as desired for a particular application.

First and second siding members 122, 124 are attached on opposite sides (e.g. front and back, inside and outside, etc.) of the frame 112 to provide a structural panel having a cavity 126 defined by the siding members 122, 124 and the frame 112 (or multiple cavities in the event that the panel includes one or more internal structural members). The siding members may be provided as any type of siding having a desired strength and appearance for a particular application. According to one embodiment, the siding members are provided as metallic sheet material (e.g. "skin", etc.), however the siding members may also be oriented strand board (OSB) having a thickness of approximately 7/16 inches (or other thicknesses as determined by performance specifications for a particular enclosure). Further, other types of panels or siding having any suitable thickness and desired architectural appearance to provide a desired thermal, fire and/or environmental boundary performance and appearance for use in a particular application. For example, the siding members may include (or be formed from, or have applied thereto) a fire resistant or fire retardant material, and/or an antibacterial or antimicrobial treatment. Further, multiple skin options may be used with varying materials and/or thicknesses to provide specific or custom-tailored thermal, fire, or environmental performance boundaries. The siding members may be attached to the frame using any suitable method and components such as nails, screws, staples, adhesive (glue, etc.) or combination thereof, to provide a panel "shell". The cavity(ies) 126 of the shell are then filled with the insulation material 128 to provide the first type of structural insulated panel. According to one embodiment, the insulation fill material is a polyurethane foam that is injected into the cavity(ies) through a suitable small hole (not shown) cut or drilled into one of the siding members at a location corresponding to a generally central location of the cavity. The polyurethane foam is injected into the one or more cavities to provide a desired density corresponding to the desired thermal performance characteristic of the panel. According to one embodiment, the density of the insulation foam material is within a range of approximately 2.0-2.6 pounds per cubic foot.

Referring further to FIGS. 2A-2C, an improved frame member and sealing system 100 for the structural insulted panels are shown according to one embodiment. Vertical frame members 114, 116 are shown to include a number of improved sealing characteristics intended to eliminate or minimize the need for a field-applied sealant. Frame members are shown to include a structural labyrinth seal 130 formed by multiple projections 132 and recesses 134 (which may include tapered side walls to facilitate installation). Each recess 134 is shown to include a compressible seal 136. According to one embodiment, compressible seal 136 is formed from rubber or similar material and includes one or more (shown for example as two) elongated hollow core sections 138 separated by a bridge piece (e.g. web, etc.) 140 having a width sufficient to permit compression of the hollow core sections 138 in a manner that the hollow core sections 138 remain independent without touching one another. The "double" hollow core seal in each recess effectively provides four sealing points within the joint seal for the frames. The hollow core sections 138 are compressed by projections 132 upon joining of adjacent panels to one another. Sealing system 130 is also shown to include another compressible seal 146 along an outer edge of the frame member (shown for example as between the projections and the outer edge). Compressible seals 146 are formed from rubber or other suitable material and include one or more (shown for example as two) elongated, semi-circular solid core sections 148 that extend along the length of the frame member 116, and are compressed between frame members 114, 116 when adjacent panels are joined together. Each recess 134 is also shown with a depth that is slightly greater than the length of the projection 132 in order to provide space for properly engineered compression of compressible seals 136 and 146 when frame members 114 and 116 are in contact with one another. According to alternative embodiments, a third compressible seal may be provided on frame member 116 between projections 132 to provide an additional sealing surface. The structural labyrinth seal and the compressible sealing members provided in the illustrated embodiment are intended to eliminate the problems associated with field-applied caulk-type sealants that are typically used in conventional panel arrangements and provide improved sealing performance. The recesses, projections and compressible seals are all configured to be factory assembled as pre-fabricated units, so that the structural insulated panels can be readily assembled at a job site.

Figure 3A:
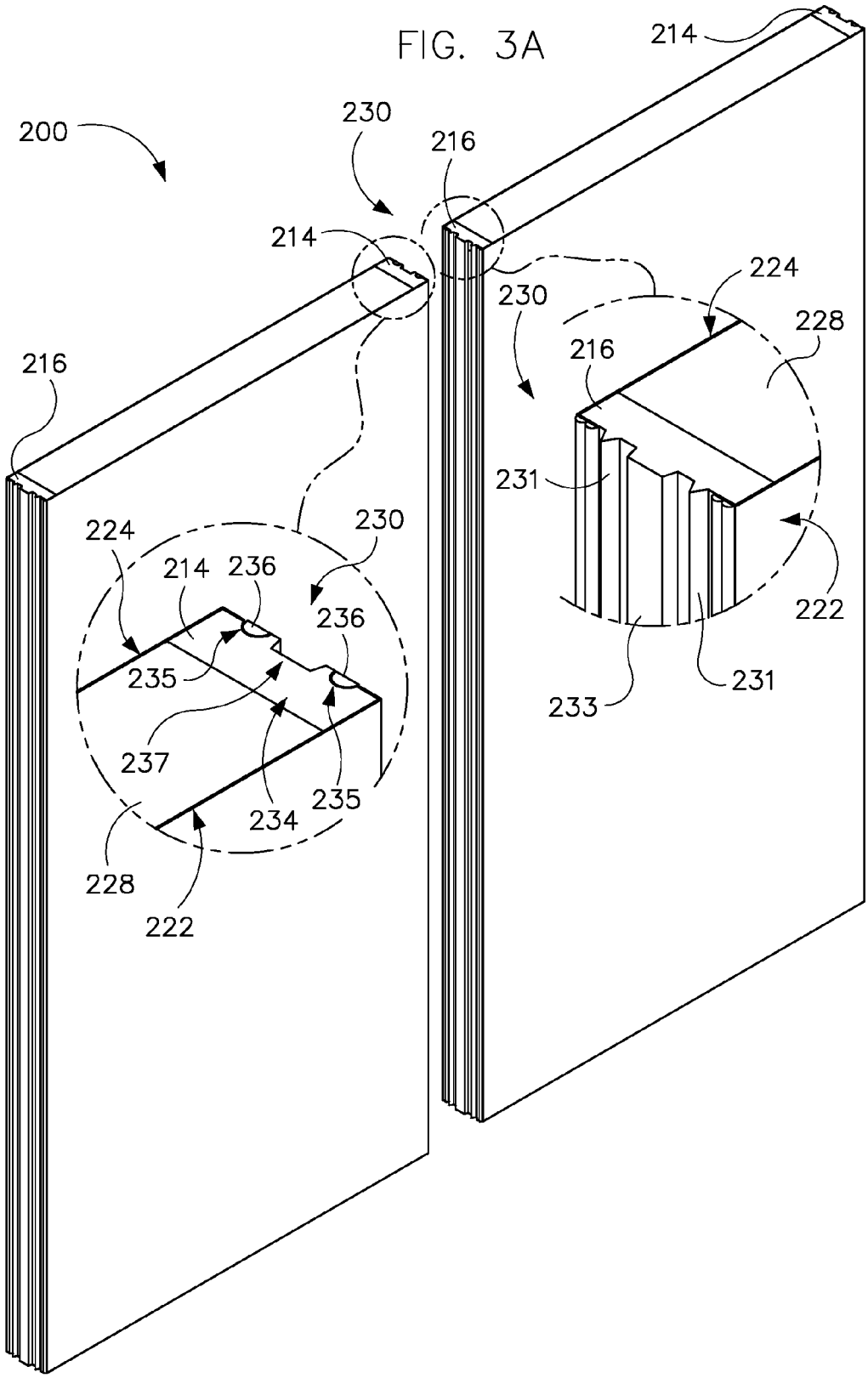
FIG. 3A is a schematic image of a perspective view of a structural insulated panel with frame members and a sealing system, according to another exemplary embodiment.
Figure 3B:
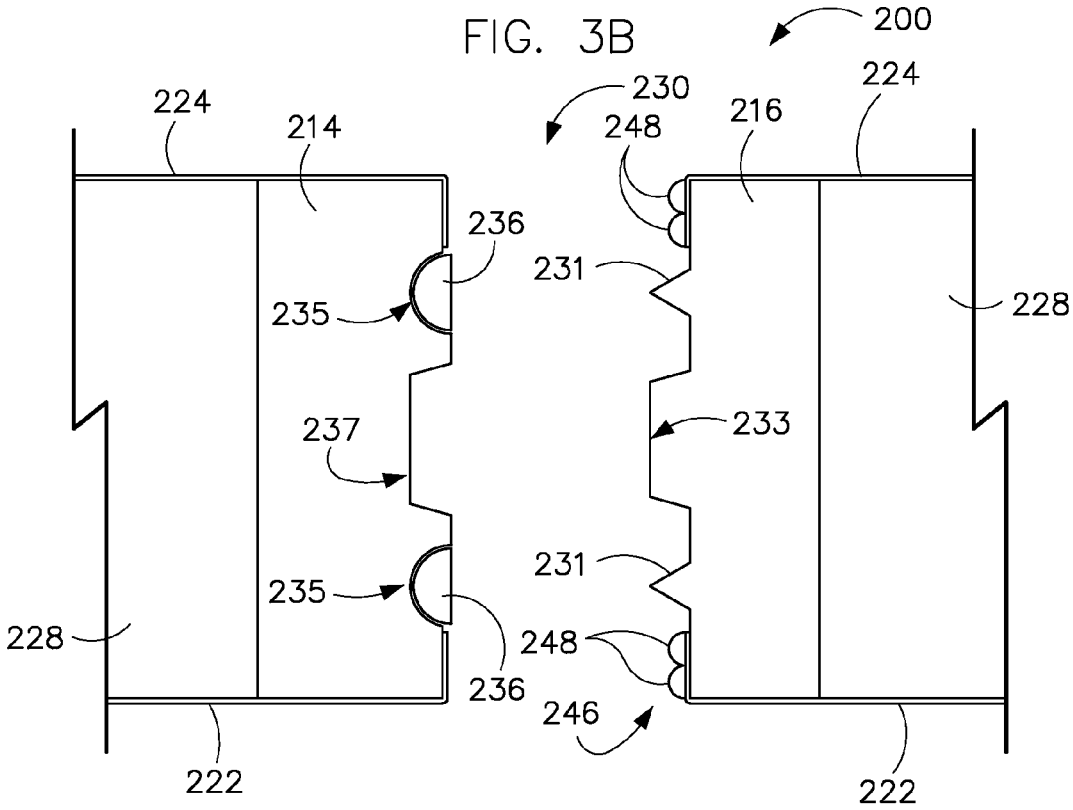
FIG. 3B is a schematic image of a top view of the structural insulated panel with frame members and a sealing system of FIG. 3A with the panels in an "open" (e.g. uncoupled, unjoined, unassembled, etc.) configuration, according to another exemplary embodiment.
Figure 3C:
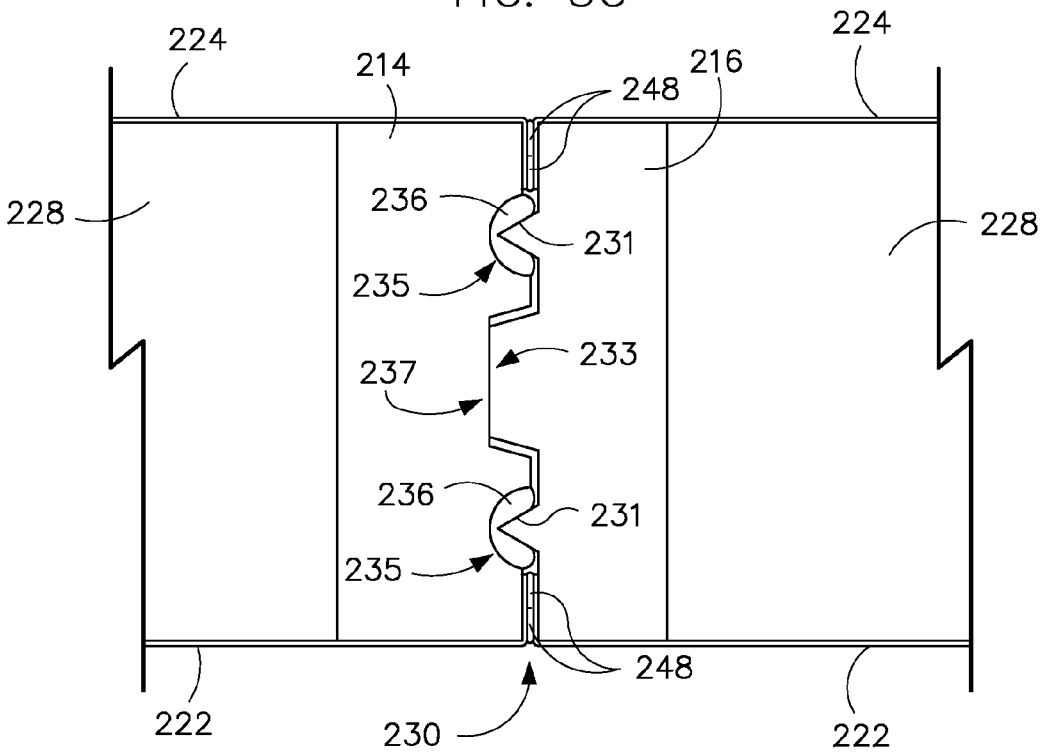
FIG. 3C is a schematic image of a top view of the structural insulated panel with frame members and a sealing system of FIG. 3A with the panels in a "closed" (e.g. coupled, joined, assembled, etc.) configuration, according to another exemplary embodiment.
Figure 4A:
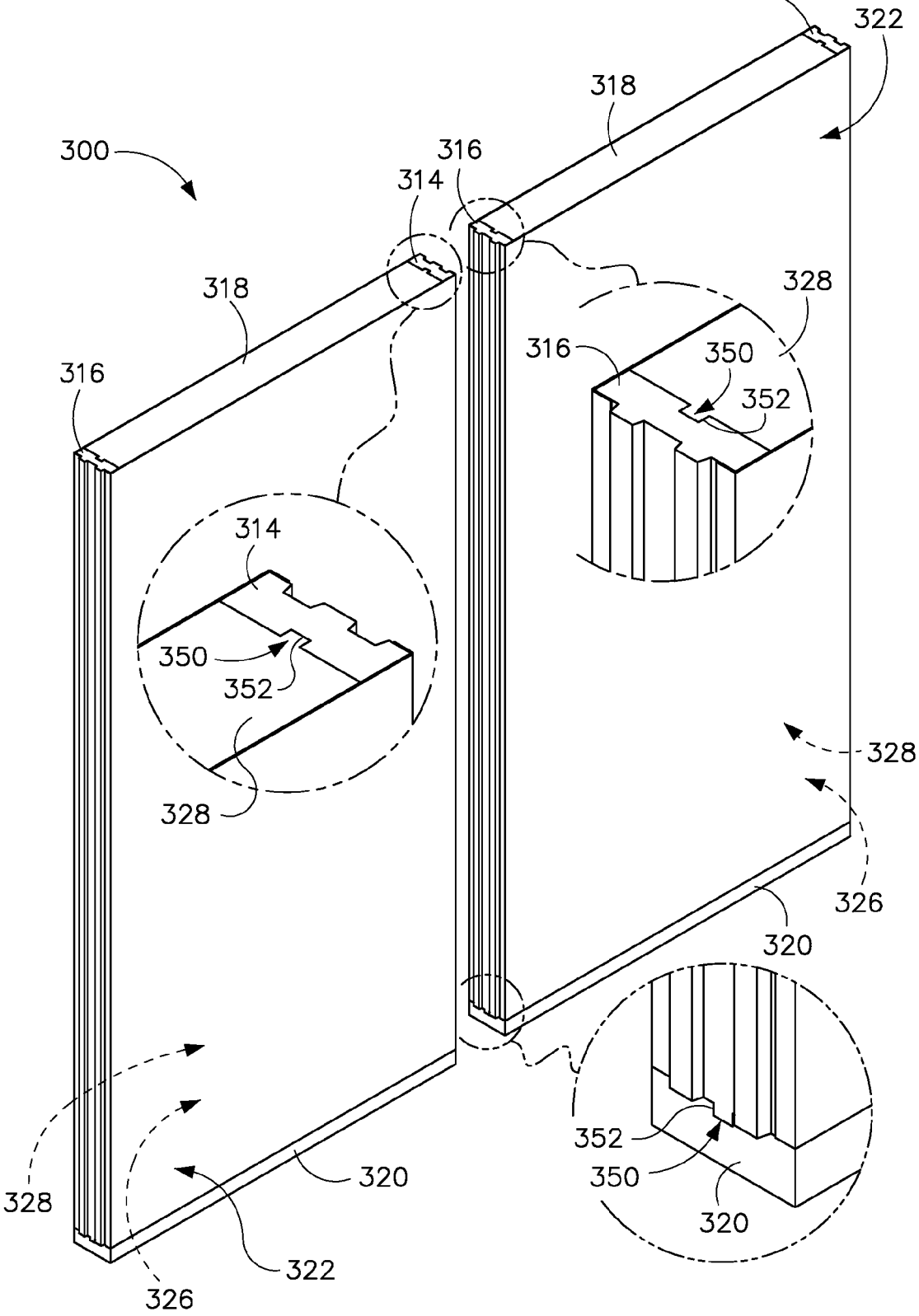
FIG. 4A is a schematic image of a perspective view of a structural insulated panel with frame members having improved thermal insulation performance, according to another exemplary embodiment.
Figure 4B:
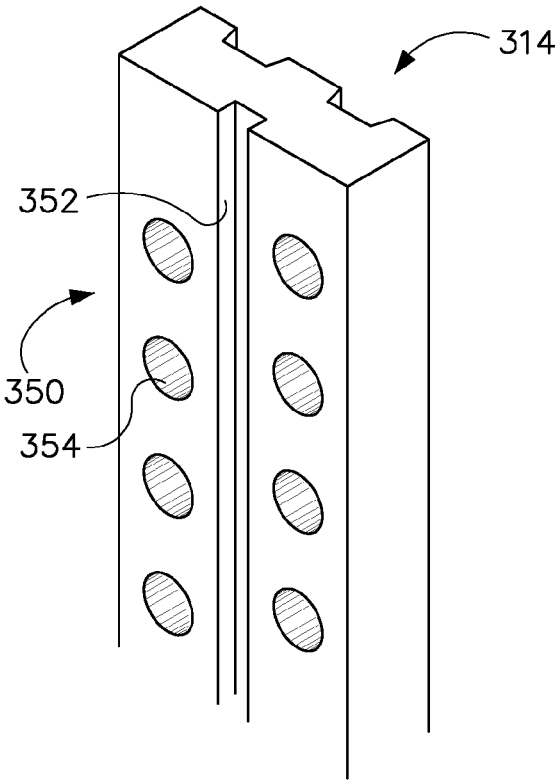
FIGS. 4B-4D are a schematic images of a perspective views of a frame members having improved thermal insulation performance of FIG. 4A, according to an exemplary embodiment.
Figure 4C:
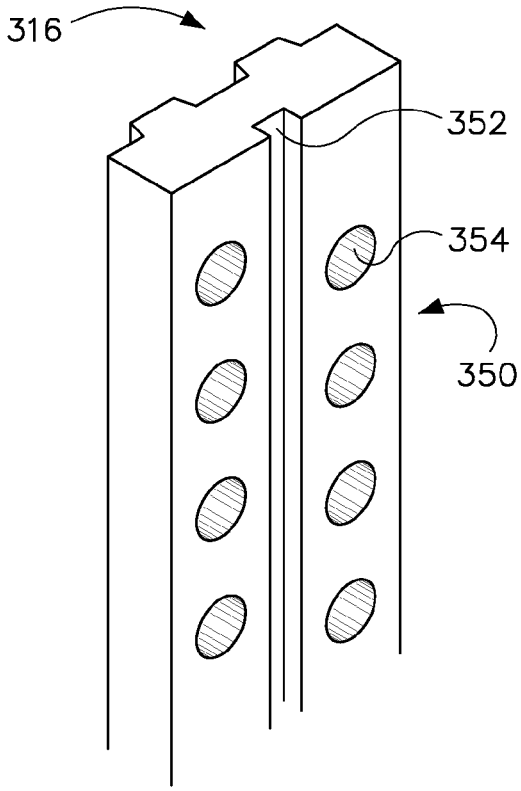
Figure 4D:
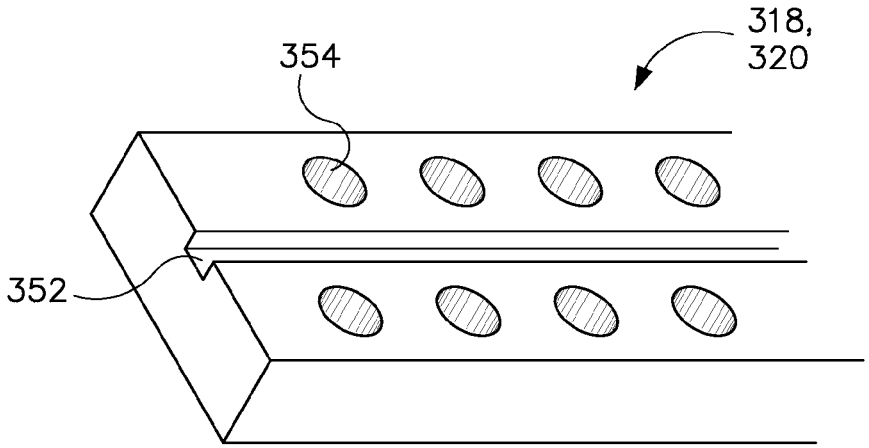

Referring further to FIGS. 3A-3C, an improved frame member and sealing system 200 for the structural insulted panels are shown according to another embodiment. Vertical frame members 214, 216 are shown to include a number of improved sealing characteristics intended to eliminate or minimize the need for a field-applied sealant. Frame members 214, 216 are shown to include another structural labyrinth seal 230 formed by multiple projections 232 and recesses 234. Recesses 234 are shown by way of example to include one or more (shown by way of example as two) substantially semi-circular recesses 235, and a substantially rectangular recess 237 (having tapered side walls to facilitate installation) disposed therebetween, however recesses with other shapes may be used according to other embodiments. Projections 232 are shown to include triangular projections 231 (e.g. ridges, etc.) corresponding to the semi-circular recesses 235 and a substantially rectangular projection 233 corresponding to rectangular recess 237. Each of the semi-circular recesses 235 is shown to include a solid core compressible seal 236 made from rubber or similar material, however hollow core compressible seals may be used according to other embodiments. Each of the compressible seals 236 in the semi-circular 235 recesses are compressed by the ridge-shaped projections 231 upon joining of adjacent panels to one another. Sealing system 230 is also shown to include another compressible seal 246 along an outer edge of the frame member 216 (shown for example as between the ridge-shaped projections 231 and the outer edge). Compressible seals 246 are formed from rubber or other suitable material and include one or more (shown for example as two) elongated, semi-circular, solid core sections 248 that extend along the length of the frame member 216, and are compressed between frame members 214, 216 when adjacent panels are joined together. Each recess is also shown with a depth that is slightly greater than the length of the corresponding projection in order to provide space (e.g. gap, etc.) for properly engineered compression of compressible seals 236 and 246. According to alternative embodiments, a third compressible seal of a type similar to compressible seal 136 previously described with reference to FIG. 2A-2C) may be provided in recess 237 to provide an additional sealing surface. The structural labyrinth seal and the compressible sealing members provided in the illustrated embodiment are intended to represent another exemplary sealing system intended to eliminate the problems associated with field-applied caulk-type sealants that are typically used in conventional panel arrangements and provide improved sealing performance. The recesses, projections and compressible seals are all configured to be factory assembled as pre-fabricated units, so that the structural insulated panels can be readily assembled at a job site.

Referring further to FIGS. 4A-4D, an improved structural insulated panel system 300 having frame members for providing enhanced thermal insulation performance for the structural insulted panels are shown according to one embodiment. Frame members 314, 316, 318, and/or 320 may include any desirable sealing system, such as previously described with reference to FIGS. 2A-2C and/or FIGS. 3A-3C. Frame members 314, 316, 318 and 320 are also shown to include voids 350 (e.g. cutouts, hollows, etc.) that are intended to be filled with insulation fill material 328 upon injection into cavity 326. The size and location of the voids 350 are selected in a manner to maximize the volume of insulation fill material 328 disposed within the boundaries of the original frame member(s), while still maintaining the structural requirements for the frame. According to one embodiment, a first void 352 includes a first recess (shown by way of example as a rectangular recess in the form of a slot, but other shapes or numbers of slots may be used in other embodiments) extending along a back (e.g. internal) side of frame members 314, 316, 318, and 320. According to another embodiment, second void includes a plurality of second recesses 354 formed in the back side of frame members 314, 316, 318, and 320. Recesses 354 are shown by way of example as substantially cylindrical recesses arranged in a staggered (e.g. alternating, zig-zag, etc.) pattern. According to the illustrated embodiment, the spacing of the recesses 354 is intended to maximize a zone of insulation to act as an improved barrier to heat transfer in a transverse direction through the panel wall (e.g. from a warm outer region to a cool inner region), while maintaining the necessary structural integrity of the panel. According to other embodiments, other recess shapes and patterns may be used to obtain a desired thermal insulation performance profile for the frame members. Additionally, creation of voids 350 within frame members 314, 316, 318, 320 that are filled with the insulation fill material have a lower density than the frame material results in a frame member having reduced weight that improves ease of shipping, handling and installing the structural insulated panels.

According to any preferred embodiment, the structural insulated panel system provides panels having frame members with improved joint sealing characteristics that eliminate or minimize the use of field-applied sealants and that provide improved thermal insulation performance with reduced weight. The vertical frame members include a structural labyrinth seal with recesses having compressible seals that are configured for engagement with mating projections from a corresponding vertical frame member on an adjacent panel upon assembly of the panels to one another in the construction of a temperature controlled storage device. The seals may be elongated sections having hollow cores configured for compression by generally planar surfaces on the corresponding projections, or may be solid core and configured for compression by non-planar surfaces (e.g. ridges, protuberances, etc.) on the corresponding projections. The frame members also include a pattern of voids that are filled with the insulation fill material from the main cavity to provide enhanced thermal performance and weight reduction of the overall panel assembly.

It is also important to note that the construction and arrangement of the elements of the structural insulated panel system as shown schematically in the FIGURES is illustrative only. Although only a few embodiments have been described in detail in this disclosure, those skilled in the art who review this disclosure will readily appreciate that many modifications are possible (e.g., variations in location, orientation and shapes of recesses, projections and insulation fill voids, etc.) without materially departing from the novel teachings and advantages of the subject matter recited.

It should also be noted that the system may include any suitable type of recesses, projections, hollow and/or solid core compressible seals to effect a desired sealing performance level. Further, the insulation fill voids in the frame members may include and shape or combination of shapes, in any desirable pattern to provide a desired thermal insulation performance while meeting or maintaining the desired structural performance characteristics for the frame. Accordingly, all such modifications are intended to be included within the scope of the present invention. Other substitutions, modifications, changes and omissions may be made in the design, construction, assembly, and arrangement of the preferred and other exemplary embodiments without departing from the spirit of the present invention.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present inventions as expressed in the appended claims.

What is claimed is:

1. An insulated enclosure comprising:

a plurality of walls, each of the plurality of walls comprising a plurality of structural insulated panels joined at joints, each of the plurality of structural insulated panels comprising a frame having a first vertical frame member defining on an outwardly disposed surface thereof a plurality of vertical recesses and a plurality of vertical projections, a second vertical frame member defining on an outwardly disposed surface thereof a plurality of vertical recesses and a plurality of vertical projections, a top frame member, a bottom frame member, and siding members disposed on opposing sides of the frame to define a cavity therebetween;

wherein the joints joining the plurality of structural insulated panels are butyl-free and comprise butyl-free compressible seals disposed between opposing recesses and projections in adjoining structural insulated panels, wherein insulation is disposed both within the structural insulated panels and within at least a portion of at least one structural insulated panel vertical frame member, and wherein the structural insulated panel vertical frame members comprise a plurality of voids extending longitudinally along the frame members and having an opening facing the cavity.

2. The insulated enclosure of claim 1, wherein the first vertical frame member, the second vertical frame member, the top frame member and the bottom frame member comprise wood.

3. The insulated enclosure of claim 2, wherein the voids are formed in the first vertical frame member and the insulation is disposed both within the voids.

4. The insulated enclosure of claim 2, wherein the voids are formed in the second vertical frame member and the insulation is disposed both within the voids.

5. The insulated enclosure of claim 4, wherein the voids are formed in the top frame member and the insulation is disposed both within the voids.

6. The insulated enclosure of claim 4, wherein the voids are formed in the bottom frame member and the insulation is disposed both within the voids.

* * * * *

UNITED STATES PATENT AND TRADEMARK OFFICE

CERTIFICATE OF CORRECTION

PATENT NO. : 8,522,500 B1
APPLICATION NO. : 13/652076
DATED : September 3, 2013
INVENTOR(S) : Marion L. Brown It is certified that error appears in the above-identified patent and that said Letters Patent is hereby corrected as shown below:

In the Claims

In column 8, line 36 (claim 4, line 1), please delete "claim 2" and insert -- claim 3 --, therefor.

Signed and Sealed this
Second Day of September, 2014

Michelle K. Lee

Michelle K. Lee
*Deputy Director of the United States Patent and Trademark Office*